US007468579B2

(12) United States Patent
Hiraki

(10) Patent No.: US 7,468,579 B2
(45) Date of Patent: Dec. 23, 2008

(54) LIGHTING DEVICE WITH ANODE INCLUDING CARBON FIBER MIXED PAPER

(75) Inventor: Akio Hiraki, Hyogo (JP)

(73) Assignee: Dialight Japan Co., Ltd., Osaka (JP)

( * ) Notice: Subject to any disclaimer, the term of this patent is extended or adjusted under 35 U.S.C. 154(b) by 0 days.

(21) Appl. No.: 11/053,912

(22) Filed: Feb. 10, 2005

(65) Prior Publication Data

US 2005/0134162 A1 Jun. 23, 2005

(51) Int. Cl.
*H01J 19/06* (2006.01)
*H01J 1/62* (2006.01)

(52) U.S. Cl. ..... 313/311; 313/496

(58) Field of Classification Search ..... 313/311, 313/495–497, 491; 445/46, 52; 427/64, 427/66–73, 77, 113, 121; 252/500–521.6
See application file for complete search history.

(56) References Cited

U.S. PATENT DOCUMENTS

| | | | | |
|---|---|---|---|---|
| 5,648,699 | A * | 7/1997 | Jin et al. | 313/309 |
| 6,392,248 | B1 * | 5/2002 | Takahara et al. | 250/580 |
| 6,858,981 | B2 * | 2/2005 | Cho et al. | 313/495 |
| 2004/0191495 | A1 | 9/2004 | Lenz | |

FOREIGN PATENT DOCUMENTS

| | | | |
|---|---|---|---|
| EP | 1 061 554 | A1 | 12/2000 |
| EP | 1 498 931 | A1 | 1/2005 |
| JP | 60-9039 | A | 1/1985 |
| JP | 60-216431 | A | 10/1985 |
| JP | 1-54664 | A | 3/1989 |
| JP | 08-42867 | | 2/1996 |
| JP | 2000-215967 | | 8/2000 |
| JP | 2001-15077 | | 1/2001 |
| JP | 2001-143645 | | 5/2001 |
| WO | WO 03/088308 | A1 | 10/2003 |

OTHER PUBLICATIONS

Japanese Office Action issued in Japanese Patent Application No. JP 2003-297104 dated on May 7, 2008.

* cited by examiner

*Primary Examiner*—Sikha Roy
*Assistant Examiner*—Anne M Hines
(74) *Attorney, Agent, or Firm*—McDermott Will & Emery LLP

(57) ABSTRACT

A carbon fiber mixed paper 8 obtained by mixing a fiber blend 7, which is obtained by knitting a carbon fiber and a glass fiber, into a paper material is used as the material for an anode that opposes to an electron emission cathode. A phosphor is applied onto this carbon fiber mixed paper 8, and further, an electrode 9 is provided. The present invention reduces heat generation at the anode as much as possible and enables uniform illumination without providing a diffuser. Moreover, the present invention does not require an electrode made of a transparent conductive film.

4 Claims, 1 Drawing Sheet

LIGHTING DEVICE WITH ANODE INCLUDING CARBON FIBER MIXED PAPER

BACKGROUND OF THE INVENTION

1. Field of the Invention

The present invention relates to a lighting device, and more particularly to a lighting device using a field emission type electron emitter.

2. Description of the Prior Arts

There has recently been proposed a thin-sized lighting device wherein electrons are emitted from an electron emission cathode by applying an electric field in a vacuum and the emitted electrons are caused to collide with a phosphor applied on an anode to thereby emit light (see Japanese Unexamined Patent Application No. 2001-15077). In such a lighting device, the anode is configured such that a transparent conductive film (ITO) and a phosphor are formed on a glass substrate.

In the lighting device described above, electrons emitted from the electron emission cathode to be accelerated collide with the phosphor to emit light, thereby giving residual energy to the anode. The anode generates heat by this energy. When high voltage is applied between the anode and the cathode in order to provide a bright light-emission, in particular, the heat generation from the anode becomes remarkably great, thereby bringing a possibility of damaging the lighting device. Further, in case where the light-emission is not uniform, it is necessary to provide a diffusion plate to the anode for diffusing light to obtain uniform light-emission.

The present invention reduces the heat generation from the anode as much as possible and enables a uniform illumination without a diffusion plate.

SUMMARY OF THE INVENTION

A lighting device according to the present invention is provided with an electron emission cathode and an anode having a phosphor, wherein the material for the anode includes a carbon fiber.

According to the present invention, the material for the anode includes a carbon fiber, whereby electrons emitted from the electron emission cathode radiate heat by the carbon fiber that is excellent in thermal conductivity, even if they collide with the anode to generate heat. It should be noted that the carbon fiber can be used as an electrode without forming a transparent conductive film as conventionally, since the carbon fiber has conductivity. The material for the anode is preferably a carbon fiber mixed paper obtained by mixing a carbon fiber into a paper material. Using a carbon fiber mixed paper obtained by mixing a carbon fiber into a paper material as the material for the anode reduces a density compared to a conventional glass substrate and reduces the heat generation when the electrons collide with the anode, thereby being capable of reducing the heat generation at the anode. Moreover, it is a mixed paper, i.e., a paper, so that it can diffuse light, which means a diffuser is not required to be provided.

More preferably, the carbon fiber mixed paper has a glass fiber mixed therein in addition to the carbon fiber. Mixing the glass fiber allows light to uniformly be diffused. More preferably, the glass fiber knitted with or weaved with the carbon fiber is mixed into the paper material. More preferably, the phosphor is applied onto the carbon fiber mixed paper. The phosphor can easily be applied in case where the material for the anode is the mixed paper.

More preferably, the phosphor is mixed into the paper material. Mixing phosphor powders into the paper material can provide an anode material having a phosphor. The tone of the light-emission can easily be adjusted by suitably selecting the mixing ratio.

More preferably, the material for the anode is a fiber blend including the carbon fiber and the glass fiber. Using a fiber blend including the carbon fiber and the glass fiber as the material for the anode reduces a density compared to a conventional glass substrate and reduces the heat generation when the electrons collide with the anode, thereby being capable of reducing the heat generation at the anode. Moreover, it is a fiber blend of the glass fiber, so that it can diffuse light, which means a diffuser is not required to be provided.

More preferably, the fiber blend is obtained by knitting or weaving the carbon fiber and the glass fiber, whereby light-emission and heat radiation can be made uniform.

More preferably, the phosphor is applied onto the fiber blend. The phosphor can easily be applied in case where the material for the anode is the fiber blend.

As described above, a material including a carbon fiber, preferably a carbon fiber mixed paper is used as the material for an anode in the present invention. Therefore, electrons emitted from an electron emission cathode collide with the mixed paper having low density, whereby the heat generation is restrained. Even if the heat generation occurs, the generated heat is radiated by the carbon fiber excellent in thermal conductivity, with the result that the heat generation can be reduced at the anode.

Further, the mixed paper is used, so that the emitted light is uniformly diffused. The inclusion of the glass fiber further promotes the diffusion, whereby the diffuser can be omitted.

Moreover, the carbon fiber has conductivity, so that the carbon fiber can be used as an electrode without forming a transparent conductive film as conventionally.

DETAILED DESCRIPTION OF PREFERRED EMBODIMENTS

Figure 1:
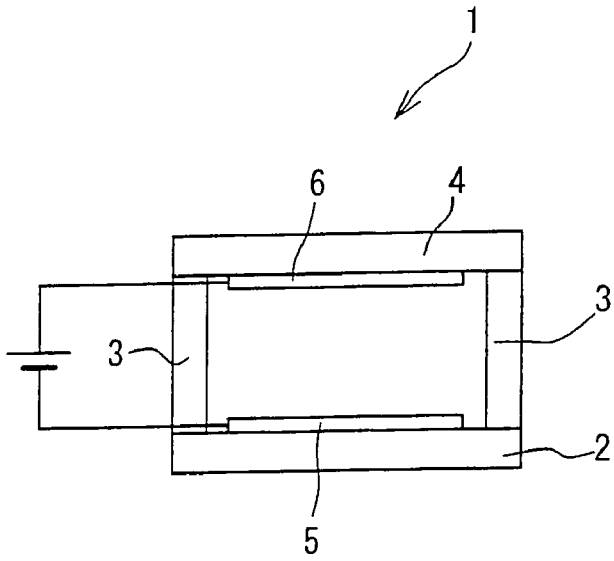
FIG. 1 is a schematic constructional view of a lighting device according to an embodiment of the present invention.

A lighting device according to an embodiment of the present invention will be explained hereinafter with reference to the attached drawings. FIG. 1 is a schematic constructional view of the lighting device according to one embodiment of the present invention. The lighting device 1 in this embodiment is vacuum-sealed by a glass substrate 2, side plates 3 and a sealing plate 4. An electron emitter 5 made of, for example, carbon nano-tube is formed on the glass substrate 2 to compose an electron emission cathode. This electron emitter 5 has a plane shape, but it may be linear as another embodiment of the present invention. An anode 6 according to the present invention is arranged so as to be opposite to the glass substrate 2, keeping a predetermined space by the side plates 3.

Figure 2:
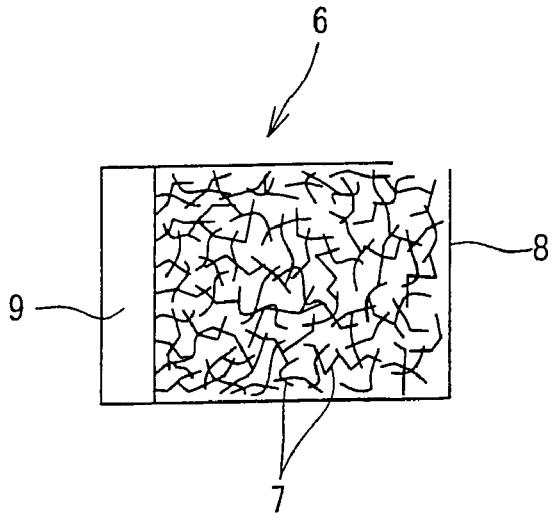
FIG. 2 is a view showing an anode of FIG. 1.

The anode 6 is made of a carbon fiber mixed paper 8 obtained by mixing a fiber blend 7, which is obtained by knitting a carbon fiber and a glass fiber, into a paper material, as shown in FIG. 2. A phosphor is applied onto this carbon fiber mixed paper 8 and an electrode 9 is provided at its one end to form the anode.

Usable paper materials include, for example, wood pulp, non-wood pulp and wastepaper pulp.

The thickness of the carbon fiber and the glass fiber is preferably a micron-order, for example.

The mixing ratio of the carbon fiber and the glass fiber is suitably selected depending on the required nonflammability and light diffusivity.

Instead of being applied onto the carbon fiber mixed paper 8, phosphor powders are mixed into the paper material in advance and the fiber blend obtained by knitting the carbon fiber and the glass fiber may be mixed. In this case, the tone of the light-emission can be adjusted by suitably adjusting the mixing ratio of the phosphor powders to the paper material.

In the lighting device 1, electrons emitted from the electron emitter 5 by the application of voltage between the electron emission cathode and the anode collide with the phosphor applied onto the carbon fiber mixed paper 8, by which the phosphor emits light.

In the embodiment, the anode 6 is made of the carbon fiber mixed paper 8. Therefore, it is easily formed, and further, the density is low compared to the conventional glass substrate as well as the heat generation is reduced when the electrons collide with the anode 6, thereby being capable of reducing the heat generation at the anode 6. Even if the heat generation occurs by the collision with the anode 6, the generated heat is radiated by the carbon fiber excellent in thermal conductivity, with the result that the heat generation can further be reduced.

Further, it is made of a mixed paper, i.e., a paper, so that it can diffuse light. Moreover, it includes the glass fiber, whereby light is uniformly diffused. Consequently, it is unnecessary to provide a diffuser.

Additionally, the carbon fiber has conductivity, thereby being used as an electrode without forming a transparent conductive film (ITO) as conventionally.

Accordingly, the electrode density at the anode can be designed depending on the density of the carbon fiber included in the carbon fiber mixed paper 8.

Although the fiber blend obtained by knitting the carbon fiber and glass fiber is mixed in the aforesaid embodiment, only the carbon fiber is mixed into the paper material as another embodiment of the invention.

Although the carbon fiber is mixed into the paper material in the aforesaid embodiment, it is not mixed into the paper material, but the carbon fiber and glass fiber are knitted or weaved to obtain a fiber blend, on which the phosphor is applied to form the anode, as another embodiment of the present invention.

In the present invention, other fibers than the carbon fiber or glass fiber may be included.

Further, conductive grains, for example, metallic grains may be mixed into the paper material as another embodiment of the present invention. This can enhance the conductivity and thermal conductivity.

Although the aforesaid embodiment is applied to a bipolar structure having a cathode and anode for explanation, it is needless to say that the invention can be similarly applied to a tripolar structure provided with a gate.

What is claimed is:

1. A lighting device comprising:

an electron emission cathode and an anode, wherein the anode includes a mixture of carbon fiber mixed paper, a glass fiber and a phosphor.

2. The lighting device of claim 1, wherein the carbon fiber mixed paper has the glass fiber mixed therein in addition to the carbon fiber.

3. The lighting device of claim 1, wherein the material for the anode is a fiber blend including the carbon fiber and the glass fiber.

4. The lighting device of claim 3, wherein the fiber blend is a knitting or a weaving of the carbon fiber and the glass fiber.

* * * * *